US007240900B2

(12) United States Patent
Sugiyama

(10) Patent No.: US 7,240,900 B2
(45) Date of Patent: Jul. 10, 2007

(54) RECORDING MEDIUM TRANSPORT DEVICE AND IMAGE FORMING APPARATUS

(75) Inventor: Wataru Sugiyama, Hazu-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 267 days.

(21) Appl. No.: 10/879,033

(22) Filed: Jun. 30, 2004

(65) Prior Publication Data

US 2005/0017441 A1 Jan. 27, 2005

(30) Foreign Application Priority Data

Jun. 30, 2003 (JP) ..... 2003-187817

(51) Int. Cl.
*B65H 7/02* (2006.01)

(52) U.S. Cl. ..... 271/265.02; 271/259

(58) Field of Classification Search ..... 271/258.01, 271/259, 261, 265.01, 265.02, 265.03
See application file for complete search history.

(56) References Cited

U.S. PATENT DOCUMENTS 5,580,042 A * 12/1996 Taniguro et al. ..... 271/274
5,582,399 A * 12/1996 Sugiura ..... 271/10.11
5,800,076 A * 9/1998 Umeda ..... 400/645.3
5,992,846 A * 11/1999 Umeda ..... 271/248

FOREIGN PATENT DOCUMENTS

| | | |
|---|---|---|
| JP | A 6-328798 | 11/1994 |
| JP | A 7-76140 | 3/1995 |
| JP | A 10-77136 | 3/1998 |

* cited by examiner

*Primary Examiner*—Patrick Mackey
*Assistant Examiner*—Kaitlin Joerger
(74) *Attorney, Agent, or Firm*—Oliff & Berridge, PLC

(57) ABSTRACT

A recording medium transport device includes a transport roller unit nipping a recording medium and transporting it to a recording area, the transport roller unit including a sheet detection lever coming in contact with a leading end part of the recording medium to detect it and a width detection lever coming in contact with the recording medium having a wide width to detect the width of the recording medium which are disposed at an upstream side of the recording area, the sheet detection lever is disposed substantially at a center part of the recording medium in a width direction, the width detection lever is disposed at a side part away from the center part toward one side in the width direction. An urging force of the width detection lever is set to be smaller than an urging force of the sheet detection lever to the recording medium.

15 Claims, 13 Drawing Sheets

RECORDING MEDIUM TRANSPORT DEVICE AND IMAGE FORMING APPARATUS

BACKGROUND OF THE INVENTION

1. Field of the Invention

The present invention relates to a recording medium transport device that nips and transports a recording medium, and an image forming apparatus including the recording medium transport device and a printing part.

2. Background Art

Conventionally, in an apparatus for forming an image by causing ink jetted from a nozzle of an ink-jet recording head to adhere to a recording medium, the recording medium (hereinafter referred to as a sheet) is made to intermittently move (step feeding) in a sub-scanning direction every specified length, and during the stop of the intermittent movement, a carriage on which the recording head is mounted is moved in a main scanning direction, and an image is formed in every specified area.

In that case, an upstream side transport roller pair at a transport upstream side (hereinafter simply referred to as an upstream side) in a sheet transport direction (sub-scanning direction) and a downstream side transport roller pair at a transport downstream side (hereinafter simply referred to as a downstream side) are disposed at both sides of the recording head, the sheet is nipped by both the roller pairs, and both the roller pairs are intermittently driven to move the sheet in the sub-scanning direction.

Incidentally, it is known from JP-A-10-77136, etc., that in order to control a state in which the leading end of the sheet is nipped by the upstream side transport roller pair and a timing when the recording head starts a printing operation to the sheet, a registration detection sensor (sheet detection sensor) for detecting the leading end of the sheet and a registration detection lever (sheet detection lever) are provided at a slightly upstream side of the upstream side transport roller pair.

In the structure according to JP-A-10-77136, a pipe shaft long in the main scanning direction is rotatably supported at a halfway part of a pinch roller holder for supporting a pinch roller pressed to a drive roller of the upstream side transport roller pair, and a front lever piece is fixed to one side (right end part) of the pipe shaft. The front lever piece is made to face on a lower place from a rectangular hole bored in the right end part of the pinch roller holder, and the tip of the front lever piece is positioned on a side of a nipped part of the sheet by the upstream side transport roller pair. Then, an upper end of a rear lever piece provided to be coupled with a left end part of the pipe shaft is urged by a torsion spring so that it enters the sheet detection sensor composed of a photo interrupter.

On the other hand, it is known from JP-A-7-76140, etc., that a width detection sensor for detecting a sheet width is provided, and a printing work area is controlled correspondingly to the sheet width in a direction orthogonal to a sheet transport direction.

In JP-A-7-76140, plural sheet detection levels are disposed in the main scanning direction in, for example, ascending order of sheet width and at respective partition places of a postcard size, a B5 size, a LTR (letter) size, and an A4 size, and the plural sheet width detection levers are disposed while their phases are shifted from each other in the rotation direction. In addition to those, one second switch lever is disposed at a downstream side of detection positions of the plural sheet width detection levers, and a difference in time between detection of a sheet by the sheet width detection lever and detection of the sheet by the second switch lever is judged to detect the sheet size.

In the mechanical sensor such as the registration sensor (the sheet detection lever, the registration detection lever) and the sheet width detection lever in JP-A-10-77136 and JP-A-7-76140 as the prior art, every lever is spring urged in a direction of blocking the sheet transport path in a state where the sheet is not detected.

SUMMARY OF THE INVENTION

However, when the urging spring force to the registration detection lever and the sheet width detection lever is large, the advance of the leading edge of the transported sheet is blocked by the urging force.

In general, while the sheet detection lever (registration detection lever) is disposed substantially at the center part in the sheet width direction, the sheet width detection lever is disposed at the place near the side in the sheet width direction, and therefore, for example, when it is assumed that the urging spring forces to the registration detection lever and the sheet width detection lever are equal to each other, with respect to the center line of the sheet in the width direction, the resistance moment (=urging spring force*distance from the sheet contact position of the sheet width detection lever to the center line) to the sheet by the sheet width detection lever becomes larger than the resistance moment (=urging spring force*distance from the sheet contact position of the registration detection lever to the center line) to the sheet by the registration detection lever, and there has been a problem that the sheet is obliquely moved during the transport.

Besides, in the respective prior arts, there has been a problem that due to the structure of the shaft support portion for preventing the lever from coming off carelessly, it takes much labor to assemble the lever and the urging spring.

A recording medium transport device and an image forming apparatus using the same are disclosed herein, in which oblique movement of a transported sheet (recording medium) is removed, and an assembling operation of a detection lever as a mechanical sensor and an urging spring can be easily performed.

According to one aspect of the invention, a recording medium transport device includes: a transport roller unit that nips a recording medium and transports it to a recording area, the transport roller unit including a sheet detection lever coming in contact with a leading end part of the recording medium in a transport direction to detect it and a width detection lever coming in contact with the recording medium having a wide width in a width direction orthogonal to the transport direction to detect the width of the recording medium which are disposed at an upstream side of the recording area in the transport direction, the sheet detection lever is disposed substantially at a center part of the recording medium in the width direction, the width detection lever is disposed at a side part away from the center part toward one side in the width direction; wherein an urging force of the width detection lever is set to be smaller than an urging force of the sheet detection lever to the recording medium.

BRIEF DESCRIPTION OF THE DRAWINGS

The present invention may be more readily described with reference to the accompanying drawings.

DETAILED DESCRIPTION OF THE PREFERRED EMBODIMENTS

A preferred embodiment of the present invention will be described with reference to FIGS. 1 to 13. The embodiment of the invention is applied to a recording medium transport device 3 to a printing part using an ink-jet recording head 2 in a multifunction apparatus 1 having a facsimile function, a scanner function, a copying function and a printer function.

Figure 1:
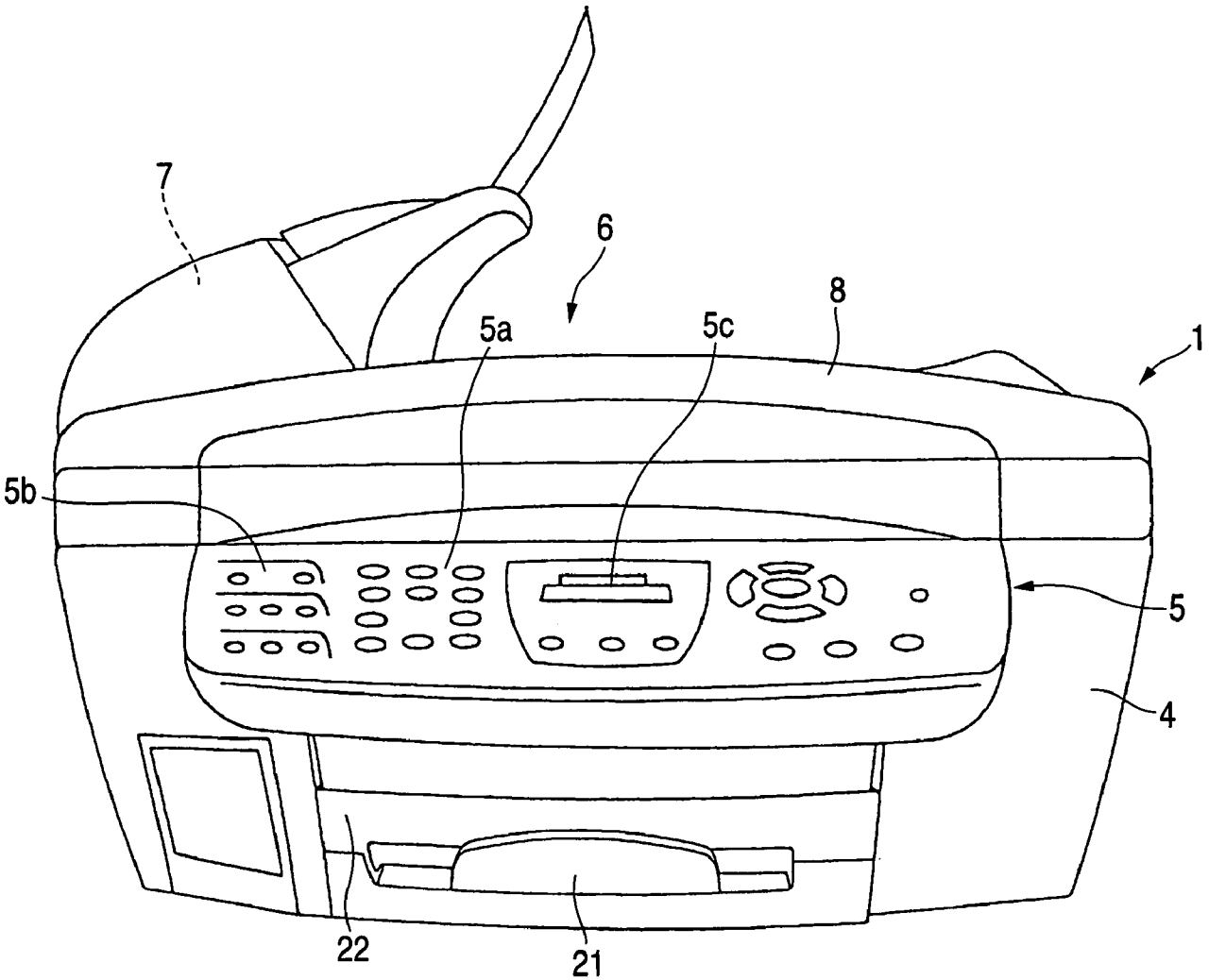
FIG. 1 is a whole front view of a multifunction apparatus.

As shown in FIG. 1, a front part of an upper surface in a main body case 4 of the multifunction apparatus 1 is provided with an operation panel part 5 including a ten-key pad 5*a* for executing the facsimile function, the scanner function and the copying function, a button key 5*b* for instructing various operations, a liquid crystal panel 5*c* and the like.

A document read device 6 provided on the upper surface of the main body case 4 and having an automatic paper feed device 7 includes a cover body 8 vertically rotatably mounted to a rear edge of the main body case 4 through a hinge (not shown), the automatic paper feed device 7 provided at one side of the upper surface of the cover body 8, a read element, such as a not-shown CIS (Contact Image Sensor), positioned at the lower side of an end glass plate (not shown) fixed to one end of the upper surface of the main body case 4, and the like. Incidentally, in this embodiment, in addition to the automatic paper feed reading performed in a state where the read element is stopped at the lower side of the automatic paper feed device 7 while a document is moved, such a structure is also adopted that a document is put on a large glass plate (not shown) disposed on the upper surface of the main body 4 while a surface on which an image is formed is oriented downward, and in a state where the document is pressed by a press body (not shown) such as a sponge provided at the under surface of the cover body 8, the read element reads the image according to image read instructions while moving on a guide rail disposed along the under surface of the large glass plate.

Figure 2:
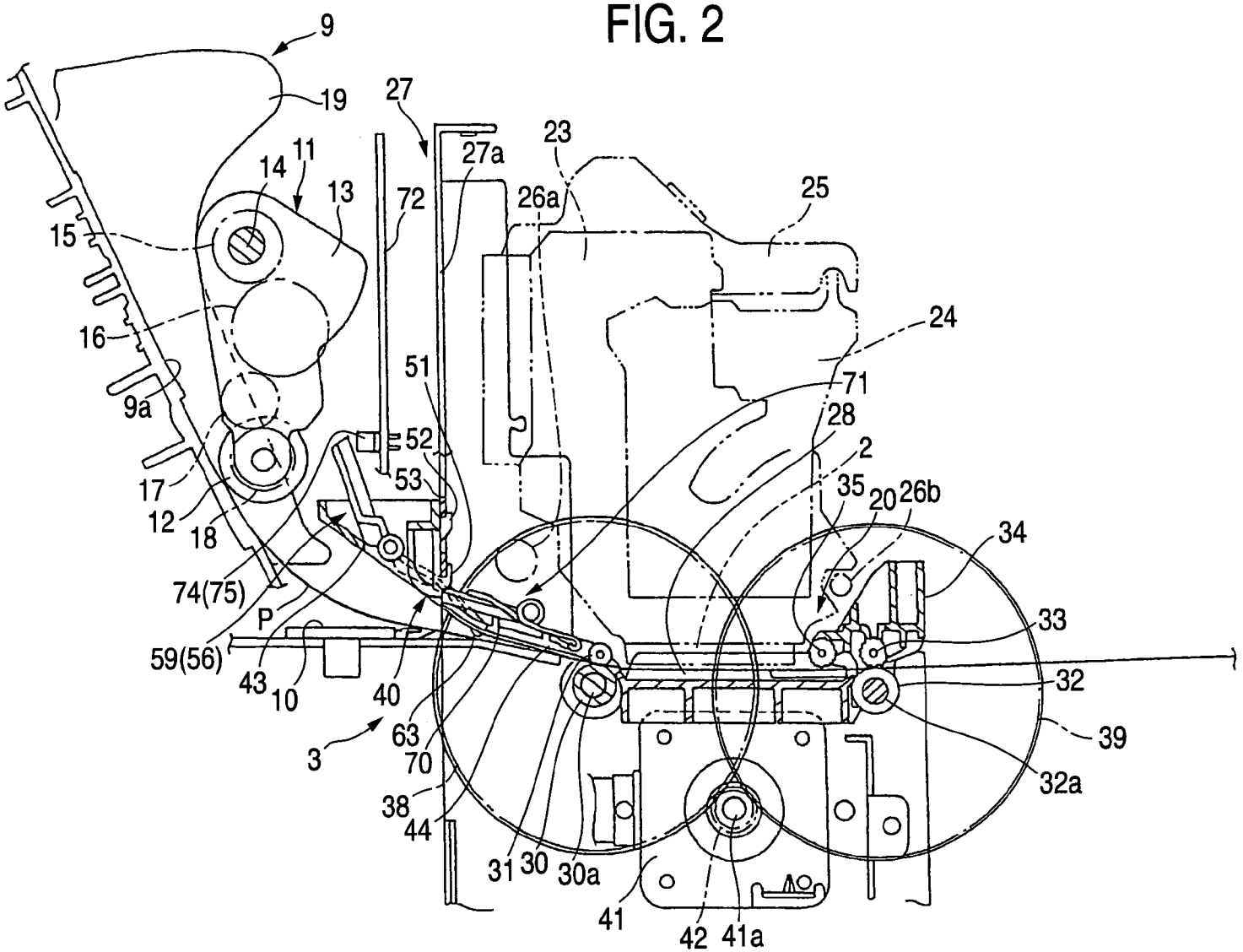
FIG. 2 is a side view of an ink-jet printing part and a recording medium transport device.

A paper feed part 9 is provided at the rear side of the main body case 4 and behind the cover body 8. As shown in FIG. 2, a paper feed tray 9*a* in the paper feed part 9 is disposed to be slanted downward and forward, and sheets P cut into a predetermined size as an example of recording media set in a stacked state are put on the paper feed tray 9*a* so that their lower end edges come in contact with a separating plate 10. At the surface side (front side) of the paper feed tray 9*a*, a case 13 of a paper feed roller unit 11 including a paper feed roller (pickup roller) 12 as a paper feed unit is rotatably mounted to a halfway part of a transmission shaft 14 in a longitudinal direction. In the case 13, there are disposed a drive gear 15 rotated integrally with the transmission shaft 14, a planetary gear 16 supported at the tip of a planetary arm (not shown) rotatably fitted to the transmission shaft 14 and engaging with the drive gear 15, an intermediate gear 17, and a gear 18 rotated integrally with the paper feed roller 12. Besides, although not shown, the case 13 is elastically urged by a torsion spring so that the paper feed roller 12 is pressed to the uppermost surface of the stacked sheets P.

Incidentally, a pair of sheet guide plates 19 (FIG. 2 shows only one of them) for guiding both the right and left side edges of the transported sheet P are mounted to the paper feed tray 9*a* to be horizontally movable in synchronization. Accordingly, in the paper feed tray 9*a*, the sheet P is transported by the recording medium transport device 3 in a state where its center in the width direction is coincident with the center position of an after-mentioned printing part 20 in the horizontal width. Further, at the front surface of the main body case 4, a paper output tray 21 for receiving a recording medium after an image is formed in the printing part 20 protrudes forward from an opening part 22.

Figure 3:
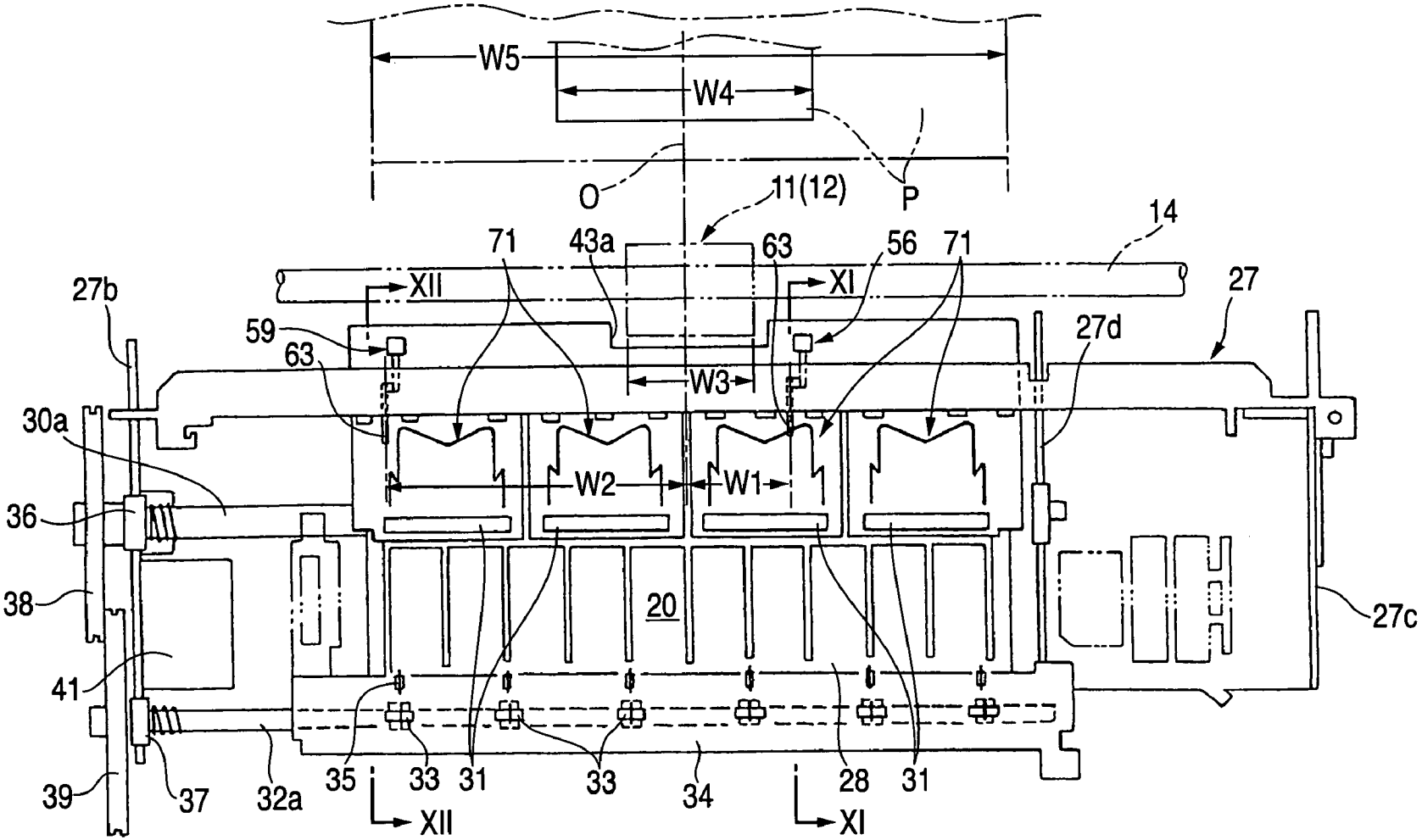
FIG. 3 is a plan view of the recording medium transport device.
Figure 4:
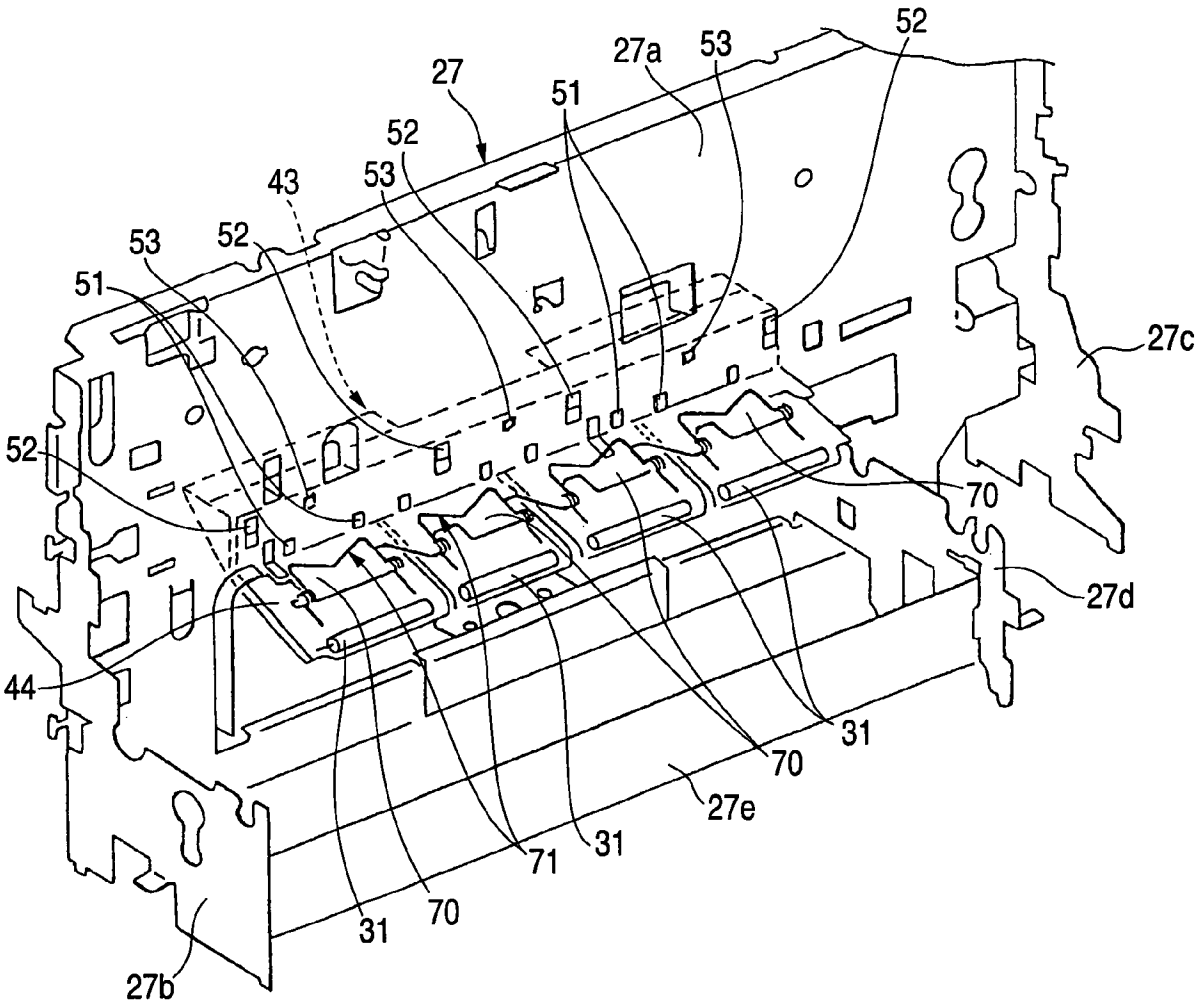
FIG. 4 is a front perspective view of the recording medium transport device in a state where it is mounted to a frame.
Figure 5:
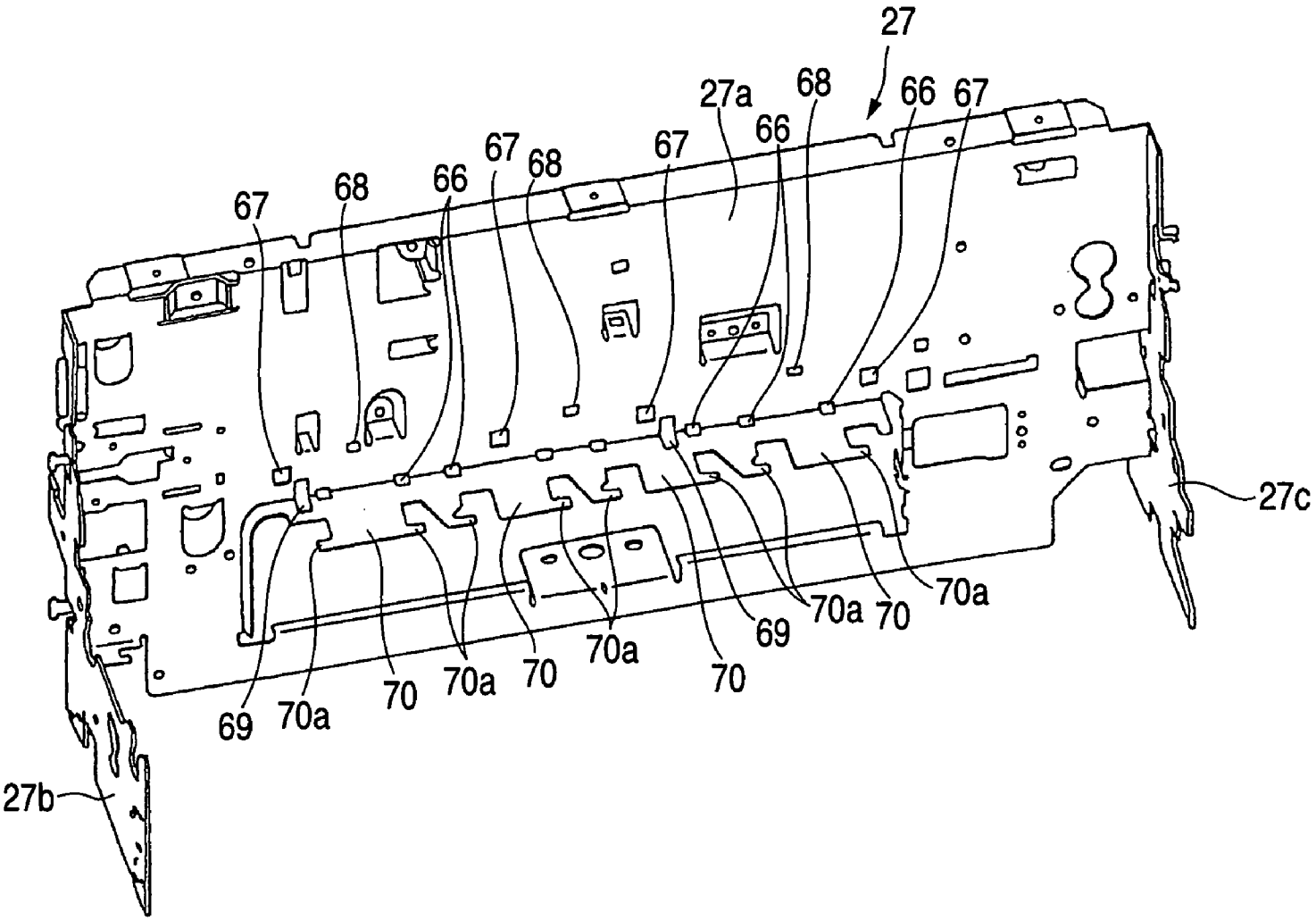
FIG. 5 is a front perspective view of the frame.

FIG. 2 is a side sectional view of the printing part 20 of the ink-jet recording head 2 and the recording medium transport device 3. The paper feed tray 9*a*, the paper feed roller unit 11, and the like are disposed at the transport upstream side of a frame 27 made of a metal plate and formed to be bent into a C shape when viewed on a plane as shown in FIGS. 3 to 5, and the after-mentioned printing part 20 and the recording medium transport device 3 are disposed at the transport downstream side thereof.

The frame 27 includes a main frame part 27*a* long along a width direction (also called a moving direction of a carriage or a main scanning direction, and the same shall apply hereinafter) of the sheet P, a side frame part 27*b* (27*c*) bent from both the right and left ends of the main frame 27*a* toward a transport direction (also called a sub-scanning direction, and the same shall apply hereinafter) of the sheet P and extending toward the downstream side in the transport direction, a side frame part 27*d* protruding, as a separate plate, from a halfway part of the main frame part 27*a* in the horizontal direction toward the downstream side in the transport direction, and a reinforcement part 27*e* for coupling the front end parts of the side frames 27*b* and 27*d* positioned at both the right and left sides (see FIGS. 4 and 5).

A carriage 23 is slidably mounted along two guide shafts 26*a* and 26*b* laid in a horizontal longitudinal direction between the pair of side frames 27*b* (27*d*). The recording head 2 of the color ink-jet cartridge type is mounted in the carriage 23 while its nozzle surface is oriented downward. Besides, ink cartridges 24 in which inks of respective colors of cyan, yellow, magenta and black are stored are detachably mounted on the upper surface of the recording head 2. Incidentally, the ink cartridge of each color is pressed downward and can be fixed by a lever 25 vertically rotatably provided at an upper end of the carriage 23.

The carriage 23 coupled with an endless timing belt (not shown) provided in parallel to the guide shaft 26*a* is constructed such that the carriage 23 can be reciprocated in the main scanning direction by the operation of a carriage motor (not shown) for driving the timing belt.

A platen 28 is disposed below the carriage 23 to face a nozzle surface of the recording head 2 and to extend in the main scanning direction.

Next, a structure of the recording medium transport device 3 will be described. In order to nip and intermittently transport the sheet P as the recording medium fed one by one from the paper feed roller 12 provided in the paper feed part 9 and separating plate 10, the recording medium transport device 3 includes an upstream side transport roller pair 30, 31 as a first transport roller pair and a downstream side transport roller pair 32, 33 as a second transport roller pair. The upstream side roller pair 30, 31 are disposed at the upstream side of the platen 28, and the downstream side transport roller pair 32, 33 are disposed at the downstream side thereof.

Each of the drive roller 30 disposed at the lower side in the upstream side transport roller pair, and the drive roller 32 disposed at the lower side in the downstream side transport roller pair is one roller elongated in the main scanning direction. Then, a material having a large frictional coefficient, such as rubber, is coated around the outer periphery of each of round rod-like shafts 30*a* and 32*a* made of metal. Both end parts (FIG. 3 shows only one of them) of each of the shafts 30*a* and 32*a* are supported by the pair of side frame parts 27*b* (27*d*) through bearings 36 and 37 made of synthetic resin. A transmission gear 38 fixed to one end of the shaft 30*a* of the upstream side drive roller 30 and a transmission gear 39 fixed to one end of the shaft 32*a* of the downstream side drive roller 32 are constructed such that they are synchronized with each other through a pinion gear 42 attached to a motor shaft 41*a* of a transport motor 41 (see FIG. 3) and are rotated in the same direction (see FIGS. 2 and 3).

The pinch rollers 31 as driven rollers disposed at the upper side in the upstream side transport roller pair are disposed at suitable intervals in the main scanning direction on the upper surface of the drive roller 30. Each of the pinch rollers 31 is attached to an after-mentioned pinch roller holder body 40 as a support unit for supporting and capable of independently urging it.

On the other hand, on a sheet guide 34 disposed at the downstream side of the platen 28 and at an upper part and elongated in the main scanning direction, spur-type driven rollers 33 as shown in FIG. 2 are disposed at predetermined intervals in the main scanning direction. A mode may be such that the spur-type driven rollers 33 are individually urged by elastic springs and are pressed to the drive roller 32. Besides, on the sheet guide 34, plural auxiliary spurs 35 are disposed at the upstream side of the driven rollers 33 in the main scanning direction at suitable intervals (see FIGS. 2 and 3). The recorded sheet P smoothly passes through the lower surface side of the sheet guide 34 by this auxiliary spurs 35 and is guided toward positions between the spur-type driven rollers 33 and the drive roller 32.

Figure 6:
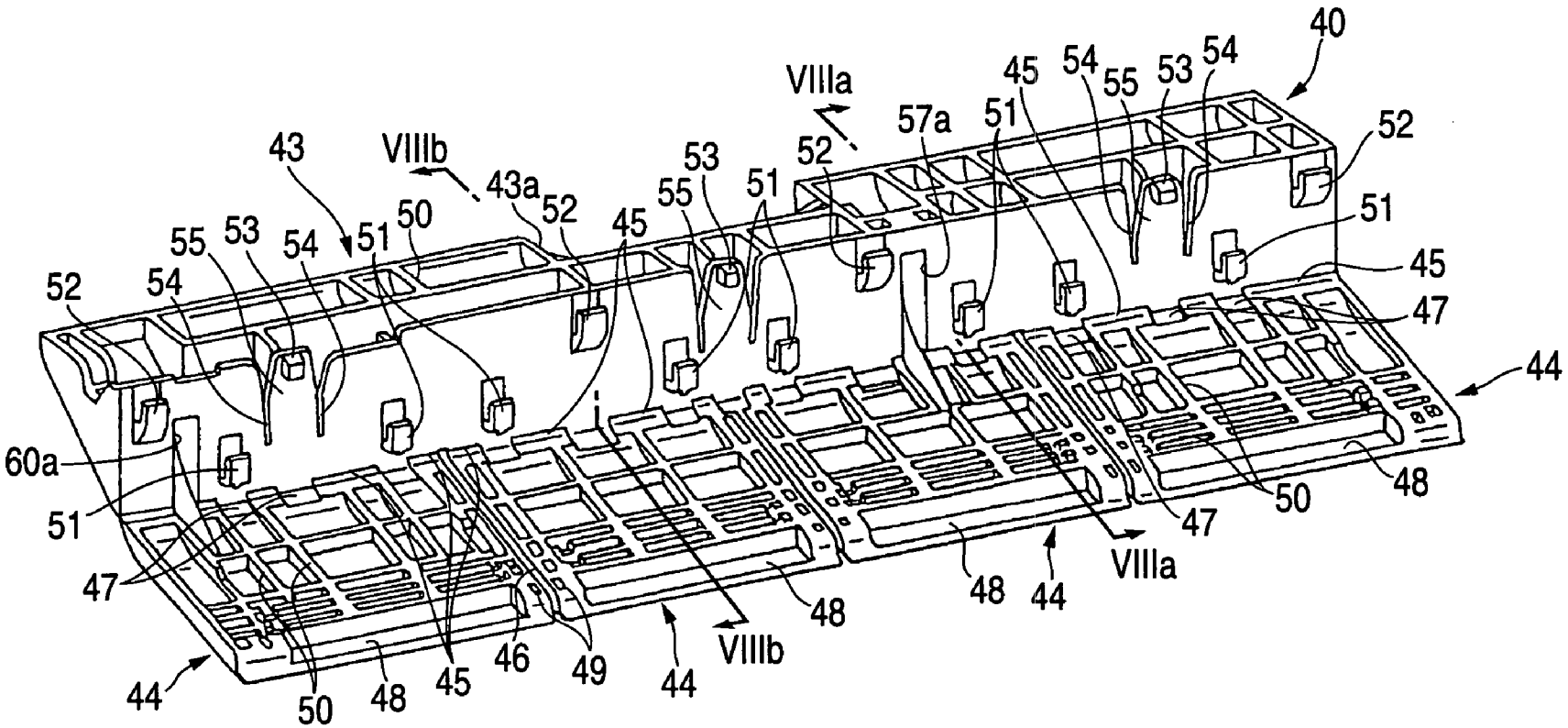
FIG. 6 is a perspective view of a pinch roller holder body.
Figure 7:
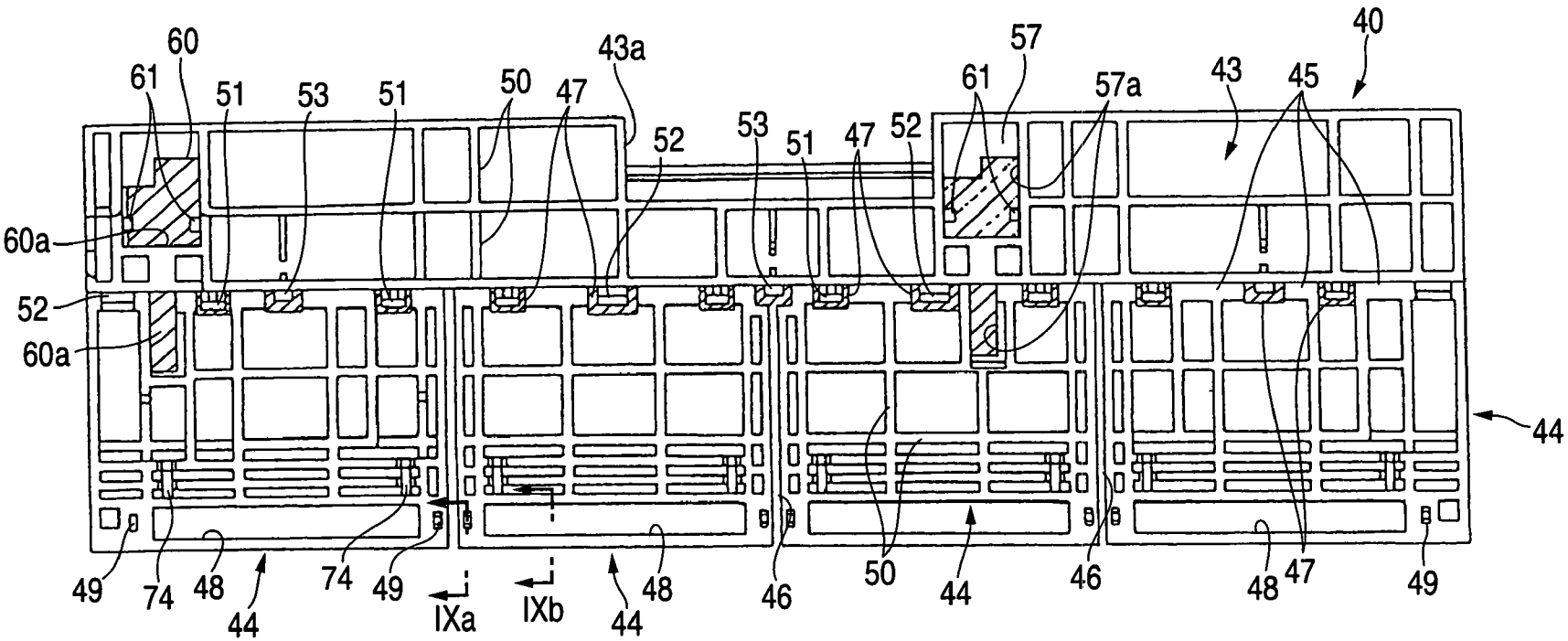
FIG. 7 is a plan view of the pinch roller holder body.
Figure 8A:
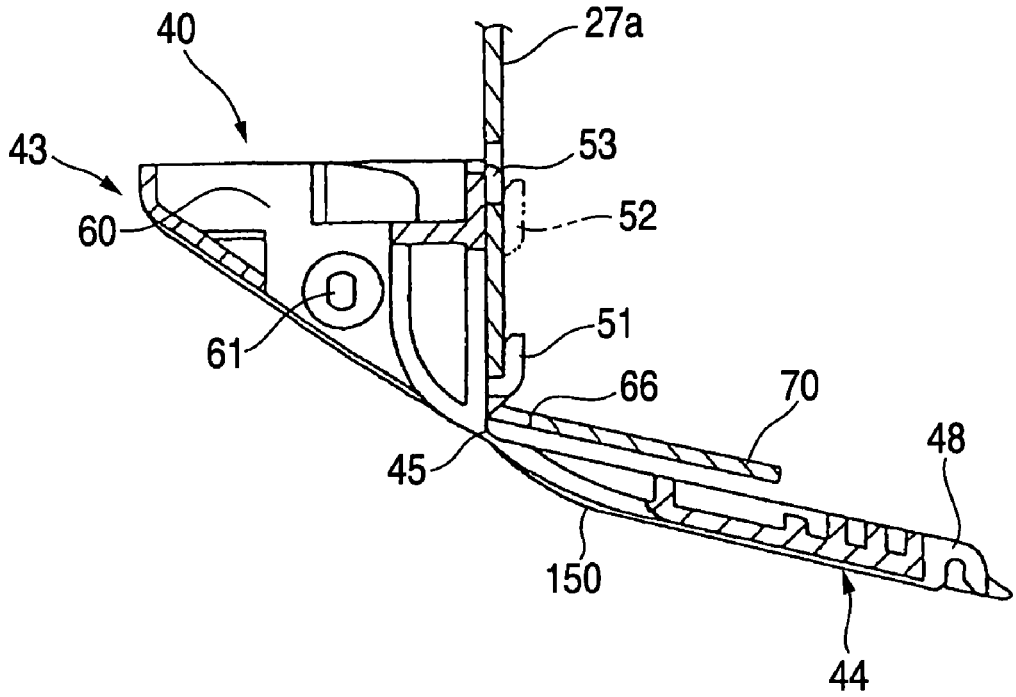
FIG. 8A is a sectional view taken along line VIIIa-VIIIa of FIG. 6.
Figure 8B:
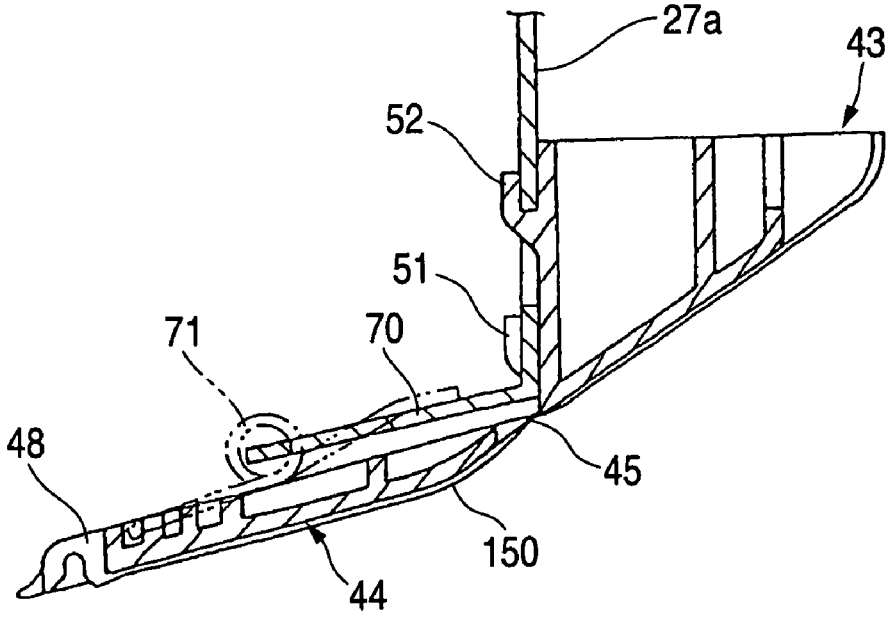
FIG. 8B is a sectional view taken along line VIIIb-VIIIb of FIG. 6.
Figure 9A:
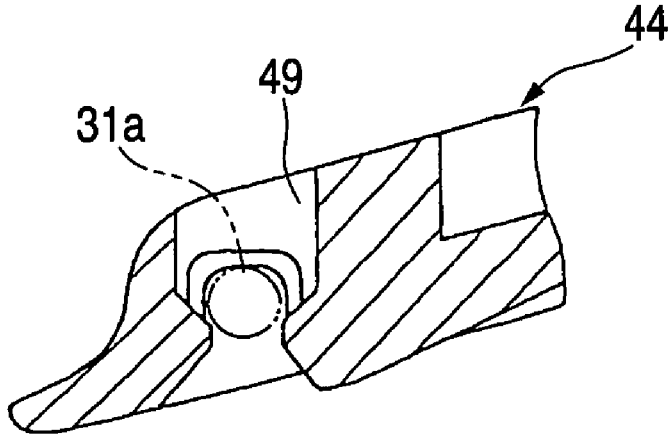
FIG. 9A is an enlarged sectional view taken along IXa-IXa of FIG. 7.
Figure 9B:
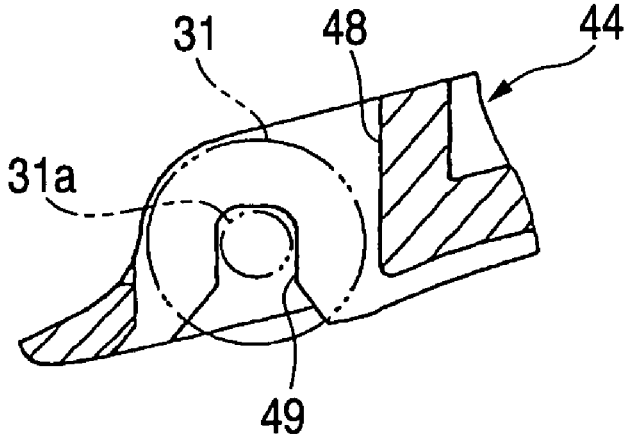
FIG. 9B is an enlarged sectional view taken along line IXb-IXb of FIG. 7.

The pinch roller holder body 40 made of synthetic resin such as POM (polyacetal resin) is such that a base part 43 elongated in the main scanning direction and support parts 44 for supporting the respective pinch rollers 31 are integrally molded by injection molding, and the respective support parts 44 are integrally connected to the one base part 43 by thin coupling parts 45 long in the width direction (main scanning direction) of the sheet P (see FIGS. 6 to 8). Further, in addition, in order that the pinch rollers 31 are disposed at symmetrical positions with respect to the center line of the sheet P in the width direction (main scanning direction), the respective support parts 44 are separated by slits 46 extending toward the downstream side in the sheet transport direction. Then, plural through holes 47 (see hatching parts in FIG. 7) are bored between the long thin coupling parts 45 as the root parts between the base part 43 and the respective support parts 44. By the thin coupling parts 45, the respective support parts 44 are constructed to be easily bent elastically and vertically with respect to the base part 43. Besides, by the existence of the through holes 47, the length of the thin coupling part 45 can be made shorter than the width size of each of the support parts 44, and the bending action can be improved.

At the tip part (the downstream side) of each of the support parts 44, there are formed a disposition hole 48 in which the pinch roller 31 is inserted from below, and attachment parts 49 which support a support shaft 31*a* protruding from both ends of the pinch roller 31 in such a manner that the support shaft can not fall off and is rotatable (see FIGS. 6, 7, 9 and 10). The base part 43 is basically formed to be a box having an open top or a frame, and the respective support parts 44 are basically formed to be flat plates. Further, plural (many) ribs 50 are integrally formed horizontally and vertically on the base part 43 and the support parts 44 in order to reduce weight and to raise rigidity. Moreover, at their bottoms, many ribs 150 (see FIG. 8, FIGS. 11 and 12 omit the illustration) extending in the sheet transport direction and for reducing contact resistance to the sheet P are provided at intervals in the width direction of the sheet P.

Then, upward first engagement hook parts 51, second hook parts 52 and substantially rectangular descending stop hooks 53 are integrally formed on the front surface of the base part 43, so that the main frame part 27*a* of the frame 27 can be positioned from the back side to produce inability to fall off and to produce inability to move in the vertical direction and the horizontal direction (see FIGS. 6, 7 and 8).

More particularly (in the embodiment), the two first engagement hook parts 51 (eight in total) are disposed for each of the support parts 44 at the lower part of a front plate 43*a* of the base part 43. The second engagement hook parts 52 are disposed at the upper part of the front plate 43*a* of the base part 43 and at four places in total, that is, at places near both the horizontal ends and near the center. The descending stop hook part 53 is integrally formed at the front surface of an elastic piece 55 formed between a pair of notch grooves 54 having open top in the front plate 43*a* of the base part 43. In the embodiment, the elastic pieces 55 are provided at three places in the horizontal direction of the base part 43 and at suitable intervals (see FIGS. 6 and 7).

Incidentally, in FIG. 7, the respective through holes 47 indicated by hatching correspond to the respective places of the first engagement hook parts 51, the second engagement hook parts 52, and the descending stop hook parts 53, are slightly larger than the shapes of the respective hook parts 51 to 53, and are substantially rectangular when viewed on a plane. The hook parts 51 to 53 and the through holes 47 are disposed as stated above, so that the respective hook parts 51 to 53 are integrally molded by a pair of metal molds at the time of injection molding of the pinch roller holder body 40.

Besides, a recess part 43*a* slightly wider than a width W3 of the paper feed roller unit 11 is formed at the back side center part of the base part 43 of the pinch roller holder body 40, so that when the paper feed roller unit 11 rotates around the transmission shaft 14, it does not interfere (see FIG. 3). A through hole 57*a* through which a registration detection lever 56 as a sheet detection lever is made to face on a lower part is bored to extend from the base part 43 of the pinch roller holder body 40 to the support part 44 through the thin coupling part 45 and at a location (in FIG. 3, an outside right part of the recess part 43*a*) slightly away from the substantially center line O in the horizontal direction (center line in the main scanning direction) and toward one side. A shaft support part 57 for vertically rotatably supporting a halfway part of the registration detection lever 56 is provided at a portion of the base part 43 communicating with the insertion hole 57*a* (see FIGS. 7, 8A, and 11).

Similarly, in order to mount a width detection lever 59, an insertion hole 60*a* through which the width detection lever 59 is made to face on a lower part is bored to extend from the base part 43 of the pinch roller holder body 40 to the support part 44 through the thin coupling part 45 and at a location (side part) largely away from the center line O in the horizontal direction and toward the other side (left side in FIG. 3). A shaft support part 60 for vertically rotatably supporting a halfway part of the width detection lever 59 is provided at a place of the base part 43 communicating with the insertion hole 60*a* (see FIGS. 7, 8A and 12). Incidentally, the insertion holes 57*a* and 60*a* are indicated by hatching in FIG. 7.

In each of the shaft support parts 57 and 60, a pair of noncircular shafts 61 are provided to be opposite to each other so as to have a suitable gap at their free end sides (see FIGS. 7, 8, 11 and 12). The noncircular shaft 61 here indicates a form in which circumstantial parts (bow portions) at both sides of a circular section are cut away linearly (shown in FIGS. 11 and 12), or a form (D type) in which a circumstantial part (bow portion) at one side of a circular section is cut away linearly, and includes a circumstantial portion at least a part in a section of a shaft.

Figure 13:
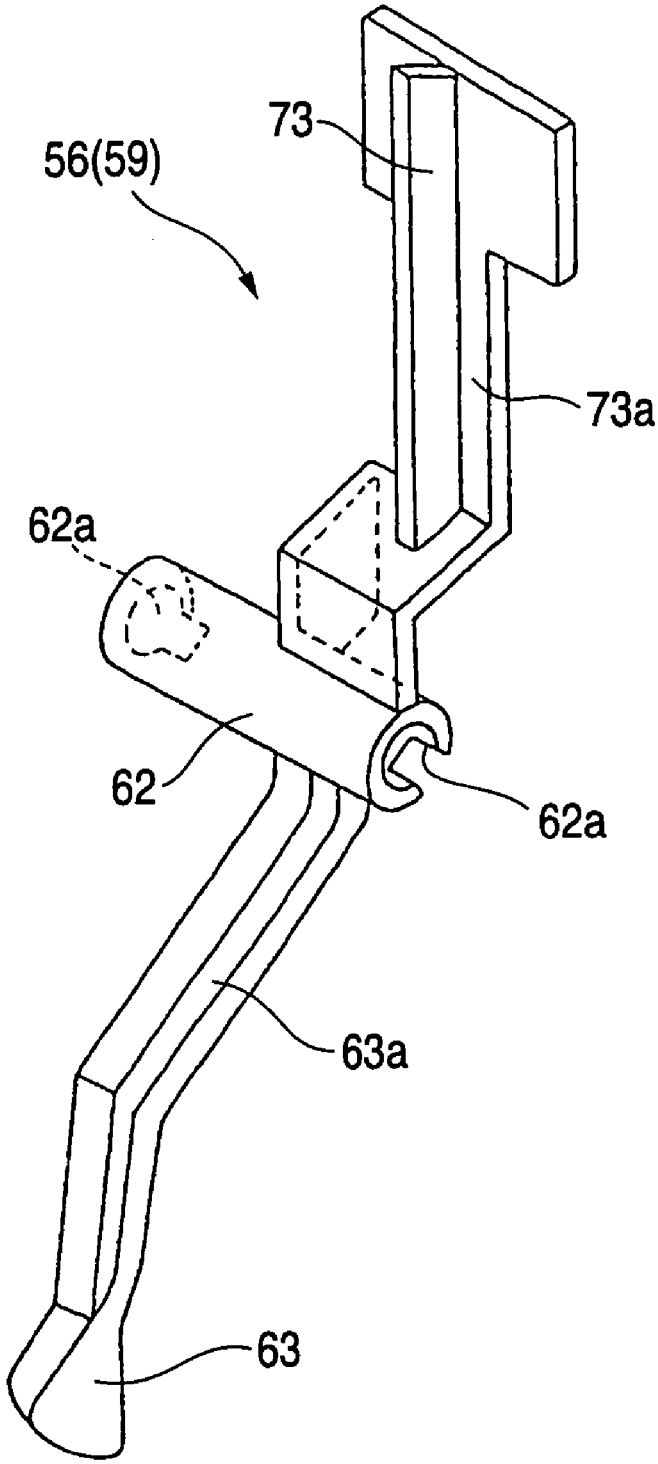
FIG. 13 is a perspective view of a registration detection lever and a width detection lever.

The registration detection lever 56 detects the leading end of the transported sheet P, and detects that the sheet P intermittently transported goes out of a nipped state which is caused by the upstream side transport roller pair 30, 31. The width detection lever 59 comes in contact with a part of the sheet P in the width direction to detect the width of the sheet P. In the embodiment, as shown in FIG. 13, the registration detection lever 56 and the width detection lever 59 are respectively integrally molded of synthetic resin, and are formed to have the same shape and the same size.

The structure of the registration lever 56 and the width detection lever 59 will be described in more detail. As shown in FIG. 13, it includes an upper lever part 73*a* and a lower lever part 63*a* at both sides of a bearing tube part 62. A detected part 73 is integrally formed at an upper end side of the upper lever part 73*a*, and a contact part 63 capable of coming in contact with the transported sheet P is integrally formed at a lower end part of the lower lever part 63*a*.

Figure 11:
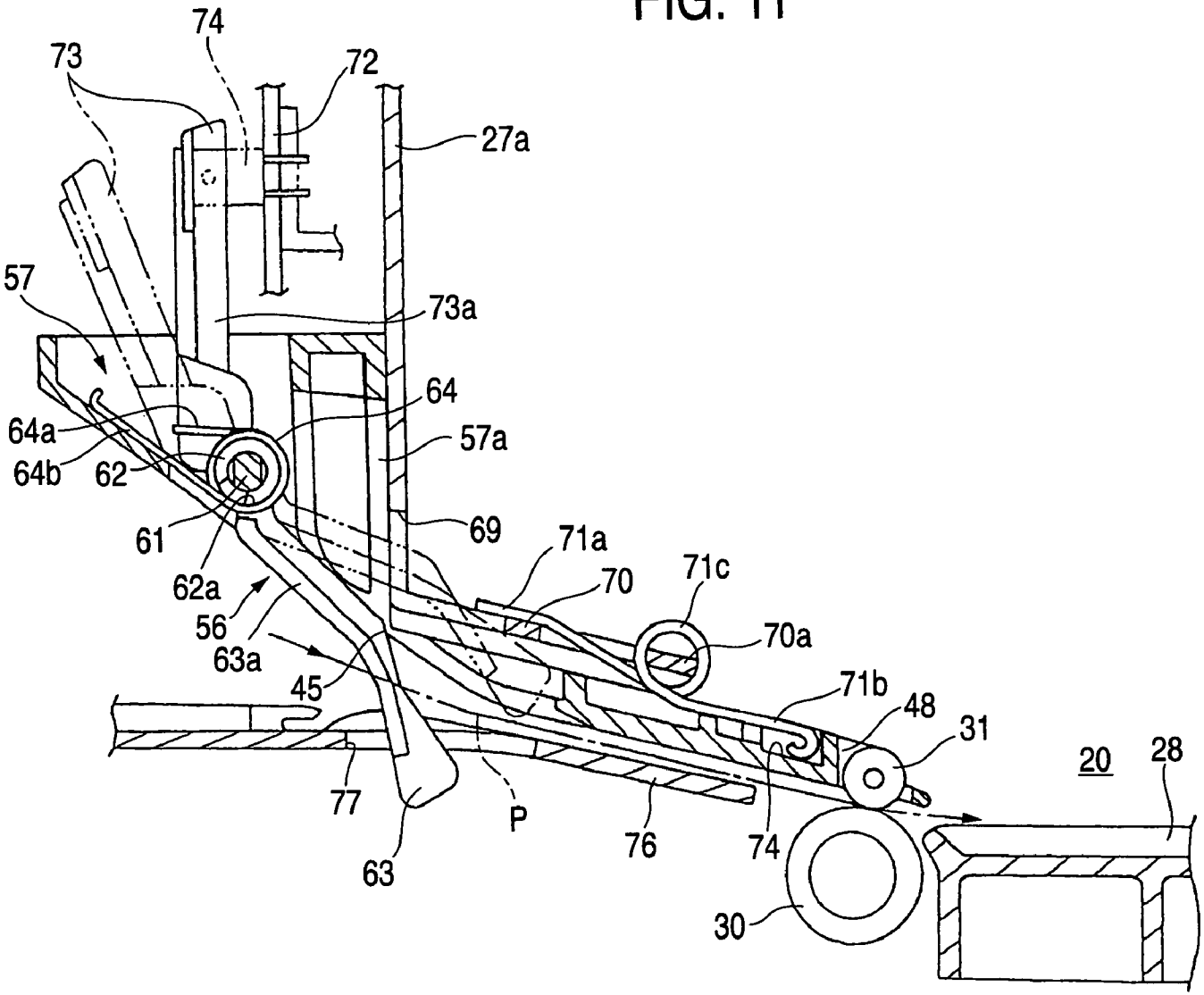
FIG. 11 is an enlarged sectional view taken along line XI-XI of FIG. 3.
Figure 12:
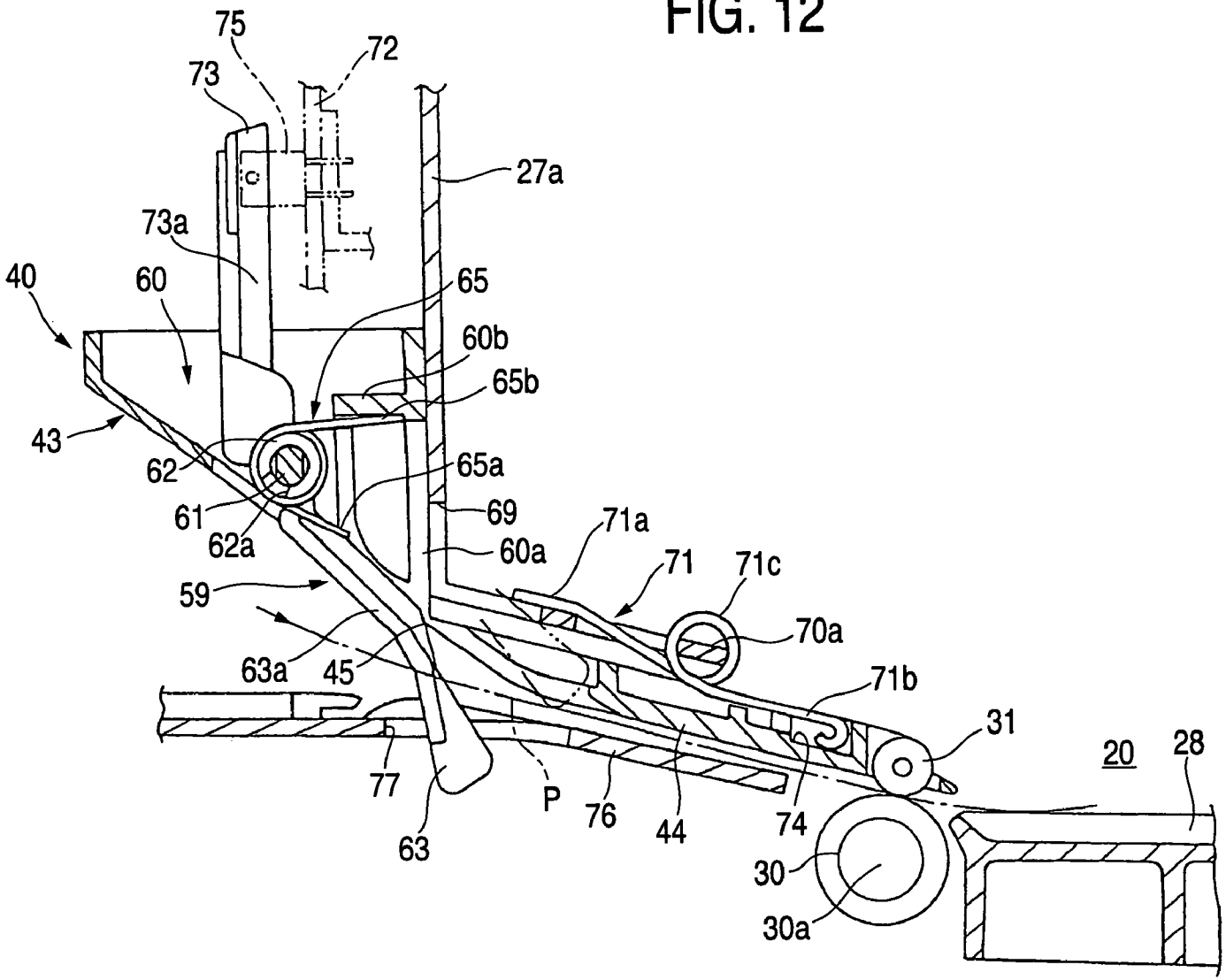
FIG. 12 is an enlarged sectional view taken along line XII-XII of FIG. 3.

An insertion groove 62*a* which can be fitted to both the noncircular shafts 61 only at a specific phase position in the direction orthogonal to an axial line of the noncircular shaft 61 is formed in the bearing tube part 62 by cutting. In this embodiment, as shown in FIGS. 11, 12 and 13, the insertion grooves 62*a* are formed by cutting, which can be fitted to the noncircular shafts 61 only when the lower lever part 63*a* at the contact part 63 side (lower end side) of each of the registration detection lever 56 and the width detection lever 59 is put into a laid state and it is inserted into the insertion hole 57*a*, 60*a* in the direction orthogonal to the axial line of the noncircular shaft 61.

When such structuring is performed, the insertion groove 62*a* is fitted to the noncircular shaft 61 and attachment/detachment becomes possible only when in a state where the lower lever part 63*a* of the detection lever 56, 59 is in contact with the upper side of a hole 69 of the main frame part 27*a*, it is pressed down, and in another posture, each of the detection levers 56 and 59 can be made not to come off although it rotates around the noncircular shaft 61.

Then, in the embodiment, as shown in FIG. 3, the contact part 63 of the registration detection lever 56 mounted in the shaft support part 57 is disposed to be away from the center line O toward the right by a distance W1, and is located at an outside position of the recess part 43*a*. The contact part 63 of the registration detection lever 56 is disposed at a position where the leading edge of the sheet P can be detected at the time of transport of every sheet P.

The contact part 63 of the width detection lever 59 mounted in the shaft support part 60 is disposed to be away from the center line O toward the left by a distance W2 (>W1), and the contact part 63 of the width detection lever 59 is set at such a position that at the time of transport of a wide width sheet (width W5) of, for example, A4 size or LTR (letter) size, it comes in contact with the sheet P, however, at the time of transport of a sheet (width W4) of post card size, it does not come in contact with the sheet P.

As shown in FIGS. 11 and 12, each of urging springs 64 and 65 for applying urging forces to the respective levers 56 and 59 has a winding part fitted to one side of the bearing tube part 62, and is a torsion spring in which a first engagement part (64*a*, 65*a*) extending from one side of the winding part and a second engagement part (64*b*, 65*b*) extending from the other side of the winding part are integrally formed. Both the urging springs 64 and 65 are made of the same material, and are set so that the winding parts are equal in winding number. That is, the respective urging springs 64 and 65 are formed such that only the shapes of the second engagement parts (64*b*, 65*b*) at one ends are different from each other.

Then, as described later, urging forces are made different in magnitude so that resistance moments at the time when both the detection levers 56 and 59 come in contact with the sheet P become equal to each other. That is, the urging force to the registration detection lever 56 is set to be large, and the urging force to the width detection lever 59 is set to be small. Thus, in this embodiment, the first engagement part 64*a* of the urging spring 64 is engaged with the back of the upper lever part 73*a* of the registration detection lever 56, and the second engagement part 64*b* is engaged with a back side, with respect to the position of the noncircular shaft 61, of the upper surface of the bottom plate of the shaft support part 57 (see FIG. 11). On the other hand, the first engagement part 65*a* of the urging spring 65 is engaged with the upper surface of the lower lever part 63*a* of the width detection lever 59, and the second engagement part 65*b* is engaged with a ceiling surface 60*b* communicating with the insertion hole 60*a* in the shaft support part 60 (see FIG. 12).

By performing the structuring as described above, setting is made such that the resistance moments (product of a force and an arm length) with respect to the center line O of the width of the sheet P become equal to each other when the leading edge of the sheet P simultaneously comes in contact with the contact parts 63 and 63 against the urging forces (K1>K2) of the urging springs 64 and 65, and the registration detection lever 56 and the width detection lever 59 are rotated. That is, K1*W1=K2*W2.

Incidentally, the urging springs 64 and 65 can be made the same components according to the arrangement of the second engagement part 64*b* for the urging spring 64 formed in the shaft support part 57 or the second engagement part 65*b* for the urging spring 65 formed in the shaft support part 60 (in this embodiment, the upper surface of the bottom plate of the shaft support part 57, or the ceiling surface 60*b* communicating with the insertion hole 60*a*).

On the other hand, in the main frame part 27*a* of the frame 27, engagement holes 66, 67 and 68 are bored to correspond to the hook parts 51, 52 and 53 in the pinch roller holder body 40 (see FIG. 5). Besides, in the main frame part 27*a*, vertically long holes 69 are bored at positions corresponding to the places of the insertion holes 57*a* and 60*a* (see FIGS. 5, 11 and 12).

Incidentally, the width size of the engagement hole 67 corresponding to one (in this embodiment, the right end in FIGS. 3 to 5) of the plural second engagement hooks 52 is made coincident with the width side of the corresponding second engagement hook part 52, so that as described later, a positioning function is achieved which makes horizontal movement impossible when the pinch roller holder body 40 is attached to the frame 27. Besides, at the lower end side of the main frame part 27*a*, spring support pieces 70 to cover the upper surfaces of the support parts 44 of the pinch roller holder body 40 substantially in parallel are integrally formed in a downward inclined shape toward the transport direction downstream side (see FIG. 5 etc.). Then, the engagement holes 66 corresponding to the first engagement hook parts 51 are formed at coupling root parts between the lower end of the main frame part 27*a* and the spring support pieces 70.

Besides, a vertical distance in the vertical direction from the upper edge of the engagement hole 66 to the lower side of the engagement hole 68 is set to be equal to a vertical distance in the vertical direction from the root part of the first engagement hook part 51 with open top to the lower surface of the descending stop hook part 53.

Incidentally, an urging spring body 71 for pressing the pinch roller 31 at the tip of each of the support parts 44 of the pinch roller holder body 40 is disposed to extend over the spring support piece 70 of the frame 27 and the support part 44, and the urging spring body 71 in the embodiment is formed such that one spring rod is bent and is integrally formed to be substantially M-shaped when viewed on a plane. In that case, one metal spring rod is bent so that the urging spring body 71 includes an M-shaped center part 71*a*, press foot parts 71*b* and 71*b* at both sides, and winding parts 71*c* at halfway parts of the respective press foot parts 71*b*.

Figure 10:
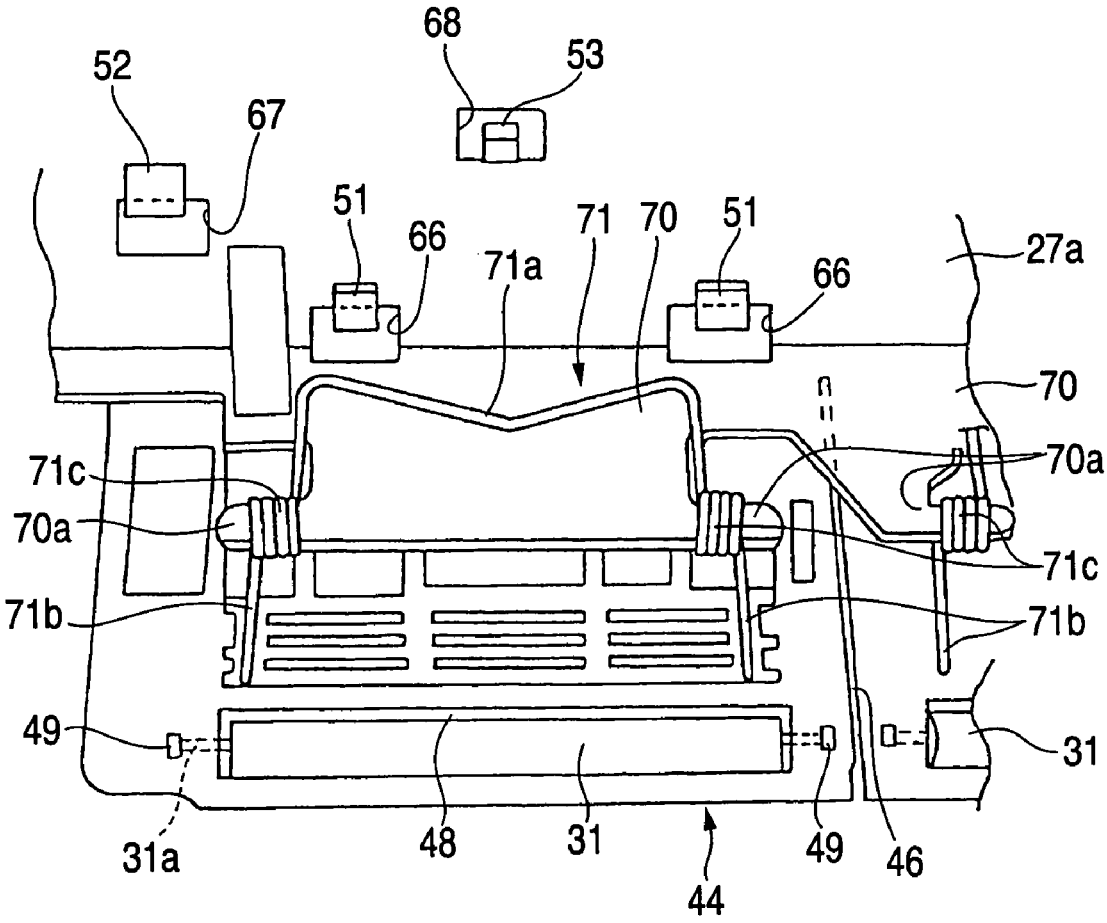
FIG. 10 is an enlarged view of a main part of FIG. 4.

Then, mount projection parts 70*a* to which the respective winding parts 71*c* are fitted from in the horizontal direction (width direction of the recording medium) and can be supported are integrally formed at both end parts of each of the spring support pieces 70 at the free end side (see FIGS. 5 and 10). More particularly, as shown in FIGS. 4 and 5, only the mount projection part 70*a* positioned at the leftmost end protrudes in the left direction, and the other mount projection parts 70*a* are formed to protrude in the right direction.

A control substrate 72 is vertically provided at the rear surface side (upstream side in the transport direction) of the main frame part 27*a* in parallel thereto, and a registration sensor 74 and a width sensor 75, such as photo interrupters, for detecting the approach of the detected parts 73 at the upper end sides of the registration detection lever 56 and the width detection lever 59 by the interruption of light are fixed at the rear surface of this control substrate 72.

In a state (state where the rear edge of the sheet P has passed) in which the lower end (contact part 63) of the detection lever 56 (59) is fitted in a hole 77 of an upper surface of the guide plate 76, the base end side (detected part 73) of the detection lever 56 (59) enters the detection part of the registration sensor 74 (width sensor 75) and an OFF signal is outputted (see a solid line state of FIGS. 11 and 12). In a state where the leading edge (upper surface) of the sheet P presses up the contact part 63 of the detection lever 56 (59) and rotates it, the detected part 73 is separated from the registration sensor 74 (width sensor 75) and an ON signal is outputted (see a two-dot chain line state of FIG. 11).

In the above structure, in order to mount the pinch roller holder body 40 to the main frame part 27*a*, the front side of the base part 43 is made to approach upward from the lower end side of the main frame part 27*a*. Then, it is pressed up in a state where the respective lower first engagement hook parts 51 are fitted in the corresponding engagement holes 66, and the second engagement hook parts 52 are fitted in the corresponding engagement holes 67. At that time, since the descending stop hook part 53 protruding forward at the upper side of each of the upward elastic pieces 55 is pressed to the rear surface of the main frame part 27*a*, the upper end side (free end side) of the elastic piece 55 is elastically deformed by the reaction force so that it is separated from the rear surface of the main frame part 27*a*. Then, when the descending stop hook part 53 is fitted in the engagement hole 68, it is fitted to the engagement hole 68 by the elastic force of the elastic piece 55 itself in a state where the lower end of each of the descending stop hook parts 53 is in contact with the lower edge of the engagement hole 68. At that time, the first engagement hook parts 51 respectively come in contact with the upper edges of the engagement holes 66, and the second engagement hook parts 52 respectively come in contact with the upper edges of the engagement holes 67. By this, the base part 43, that is, the pinch roller holder body 40 can not be moved vertically, and can be mounted to the main frame part 27*a* in the positioned state. Further, at this time, since the one second engagement hook part 52 and the engagement hole 67 are equal to each other in width size in the in main scanning direction, the base part 43, that is, the pinch roller holder body 40 can not be moved also in the horizontal direction (main scanning direction), and the horizontal location is also positioned.

As stated above, the plural hook parts 51 to 53 are provided at the front surface of the base part 43, and when the respective hook parts are engaged with the engagement holes 66 to 68 bored in the main frame part 27*a* of the frame 27, there is obtained a merit that the attachment operation of the pinch roller holder body 40 to the frame can be performed through one-touch operation.

In this state, each of the support parts 44 is disposed almost along the lower surface of the spring support piece 70 extending in the oblique down direction (direction to approach the upper surface of the drive roller 30) from the lower end of the main frame part 27*a*, and the pinch roller 31 at the tip of each of the support parts 44 approaches the upper surface of the drive roller 30. Next, the center part 71*a* of each of the urging spring bodies 71 is put on the upper surface of each of the spring support pieces 70, and when the winding parts 71*c* are fitted to the mount projection parts 70*a* of each of the spring support pieces 70, the press foot parts 71 at both the sides of the urging spring body 71 are disposed on the upper surface of the support part 44 so as to extend in the tip direction. Then, a round part of the tip (free end) of the press foot part 71*b* is fitted in an engagement recess part 74 (see FIGS. 7, 11 and 12) concavely formed in the upper surface of each of the support parts 44 and at the side part near the tip.

By this, each of the support parts 44 is coupled with the base part 43 through the thin connection part 45, and the each of the urging spring bodies 71 applies the urging force, so that the pinch roller 31 at the tip side of each of the support parts 44 is independently pressed and urged to the upper surface of the drive roller 30.

Besides, with respect to each of the urging spring bodies 71, the tip round part of the press foot part 71*b* is first fitted in the engagement recess part 74, and then, the winding part 71*c* may be fitted to the mount projection part 70*a*. For example, the respective right and left tip round parts may be fitted at the same time, or while the tip round part at one of the right and left sides is fitted in the engagement recess part 74, the winding part 71*c* is fitted to the mount projection part 70*a*, and then, the center part (M-shaped portion) 71*a* mounted on the upper surface of the spring support piece 70 is operated to push it open toward the outside or inside against the elasticity, and while the winding part 71*c* at the other side is fitted to the mount projection part 70*a*, the tip round part may be fitted in the engagement recess 74.

At this time, with respect to each of the urging spring bodies 71, since the center part 71*a* coupling the pair of left and right press foot parts 71*a* is formed to be bent like the M shape, when the winding parts 71*c* are fitted to the mount projection parts 70*a*, the push opening operation toward the fitted direction becomes very easy.

Accordingly, especially in the embodiment shown in FIGS. 4 and 5, since only the leftmost mount projection part 70*a* is formed to protrude in the left direction, at the time of mounting of the urging spring body 71 corresponding to this, it is necessary that the press foot part 71*a* is operated to be press opened outward, and the winding part 71*c* is fitted to the mount projection part 70*a*, however, there is no fear that the attachment operation becomes difficult by this.

When the leftmost mount projection part 70*a* is also made to protrude toward the right direction, a projection piece for the formation of a mount projection part is newly required at the outside (left side) of the left end spring support piece 70 shown in FIG. 5, and by that, a large opening (space corresponding to a transport path of the recording medium) must be formed in the frame, and accordingly, there is a fear that the strength of the frame is lowered. However, in this embodiment, there is no such fear.

Incidentally, the registration detection lever 56 and the width detection lever 59 are mounted to the respective bearing support parts 57 and 60 at a pre-stage in which the pinch roller holder body 40 is mounted to the frame 27. It may be mounted after the pinch roller holder body 40 is mounted.

That is, in the state (see FIGS. 11 and 12) of mounting the registration detection lever 56 and the width detection lever 59 to the pinch roller holder body 40, the contact part 63 of each of the detection levers 56 and 59 comes in contact with part of the spring support piece 70, and further rotation is restricted, and therefore, the bearing tube part 62 can not rotate up to the position (position where the insertion groove 62*a* corresponds to the thin width portion of the noncircular shaft 61) where it can be separated from the noncircular shaft 61. By this, sudden separation of the respective levers 56 and 59 in the mounting state can be certainly prevented.

However, when the insertion groove 62*a* satisfies at least the condition that it does not correspond to the thin width portion of the noncircular shaft 61 within a normal operation range of the respective levers 56 and 59 in the mount state, that is, within a range where the respective levers 56 and 59 are rotated by the contact with the sheet P, the respective levers 56 and 59 may be attached after the pinch roller holder body 40 is mounted to the frame 27.

Then, when an image formation (printer) instruction is issued by a button operation of the operation panel part 5, one of the sheets P stacked on the paper feed part 7 is fed by the rotation of the paper feed roller 12, and the leading end of the sheet P is separated from the stacked place and at the place of the separating plate 10, and is transported to the upstream side transport roller pair 32, 31 along the upper surface of the guide plate 76. In this state, the drive roller 30 is in a still state.

Next, the leading edge of the sheet P at the place near the center in the width direction pushes up the contact part 63 of the registration detection lever 56, and the registration sensor 74 outputs the ON signal. At this time, when the width size of the sheet P is large (W5/2>W2), the sheet P comes in contact with the contact part 63 of the width detection lever 59 as well and pushes up it, and the width sensor 75 outputs the ON signal. When the width size of the sheet P is small (W4/2<W2), since it does not come in contact with the sheet, the width sensor 75 keeps the OFF signal.

In this case, as described before, in the case where the sheet width size is large, when the leading edge of the sheet P simultaneously comes in contact with the contact parts 63 and 63, and the registration detection lever 56 and the width detection lever 59 are rotated against the urging forces (K1>K2) from the urging springs 64 and 65, since the registration detection lever 56 and the width detection lever 59 are disposed at right and left different sides of the paper feed roller (pickup roller) 12, the resistance moments with respect to the center line O of the width of the sheet P, which is almost coincident with the center line of the paper feed roller 12, are set to become equal to each other (K1*W1=K2*W2) at both sides of the center line O. Accordingly, at the leading edge at the time when the sheet P is transported, the contact resistances in the width direction at both sides of the center line O in the width of the sheet P become equal to each other, and the sheet P can advance without being obliquely moved. By this, the leading edge of the sheet P collides with the part (nip part) between the drive roller 30 and the pinch roller 31 in parallel over the whole in the width direction, and the registration operation is certainly performed. Incidentally, in the case of the sheet P having a small width size, the leading edge of the sheet P does not come in contact with the width detection lever 59, and the contact part 63 of the registration detection lever 56 comes in contact with the sheet at a position slightly deviating from the center line O of the width of the sheet P. However, the registration detection lever 56 is disposed near the center line O, and the absolute value of the resistance moment at the place of the contact part 63 is set to be smaller than the holding force of the paper feed roller 12, so that the oblique movement of the sheet P having the small width size can be made unnoticeable. Besides, when the sheet P is firm like the post card, there does not arise a disadvantage that the sheet itself is bent with respect to the flat plane by resistance due to the contact with the registration detection lever 56, and it can be said that any oblique movement of the sheet does not occur.

In any case, the signal of the registration sensor 74 is received and the sheet P is transported until the leading edge of the sheet P runs against (collides with) the part (nip part) between the drive roller 30 and the pinch roller 31, and after the leading edge of the sheet P is aligned to become parallel to the main scanning direction at the nip part, driving of the transport motor 41 is started.

By this, the leading end of the sheet P is nipped between the pinch roller 31 and the drive roller 30, and the drive roller 30 and the downstream side drive roller 32 are intermittently driven in synchronization with each other.

In that case, since the largeness of the width size of the sheet P is judged according to the ON signal or the OFF signal of the width sensor 75, the recording head 2 performs printing while moving in the predetermined print width and in the main scanning direction along the guide shafts 26*a* and 26*b*. Incidentally, nozzle lines (not shown) for jetting ink droplets are provided in the recording head 2 and in the sub-scanning direction. The drive roller 30 and the drive roller 32 are stopped during the time when the recording head 2 moves in the main scanning direction and performs printing, and the movement of the recording head 2 and the driving of the drive roller 30 and the drive roller 32 are alternately performed, and accordingly, the driving of the drive roller 30 and the drive roller 32 is intermittently performed. By plural intermittent rotations, the transported sheet P is ejected to the front paper output tray 21 of the multifunction apparatus 1.

Incidentally, when an air suction unit (not shown) is connected to the platen 28, and the sheet P is sucked to the upper surface of the platen 28 during the jet of ink, there is obtained an effect that an interval between the sheet P and the nozzle surface of the recording head 2 can be held constant.

After a state where the leading end of the sheet P is nipped between the downstream side transport roller pair 32, 33, although the transport speed by the downstream side transport roller pair 32, 33 is synchronized to be slightly faster than the transport speed by the transport upstream side roller pair 30, 31, since the nipping force of the downstream side transport roller pair 32, 33 is lower than the nipping force of the transport upstream side roller pair 30, 31, even if both the drive rollers 30 and 32 are driven in synchronization, the sheet P is slightly slipped at the nip part of the downstream side transport roller pair 32, 33, and the flatness of the sheet P on the platen 28 is held.

In this embodiment, by reducing the absolute values of the urging forces by the registration detection lever 56 and the width detection lever 59, the oblique movement of the transported sheet P and the paper jam can be certainly prevented. Especially, by reducing the absolute value of the urging force by the width detection lever 59 at the position deviating from the center in the width direction of the sheet P, the oblique movement of the sheet P can be removed. Incidentally, the engagement places of the first engagement parts 64*a* and 64*b* of the urging spring 64 and the first engagement parts 65*a* and 65*b* of the urging spring 65 may be set to places different from the above.

The circular shaft support hole of the inner diameter of the bearing tube part 62 of the detection lever 56, 59 in the embodiment may be formed over the whole length, and in that case, the insertion groove 62*a* is also formed over the whole length of the bearing tube part 62. On the other hand, the noncircular shaft 61 may be constructed to have one continuous form.

Besides, the urging forces of the respective levers 56 and 59 may be given by the lever's own weight, not the springs.

As described above, the recording medium transport device 3 according to this embodiment includes a transport roller unit for nipping the recording medium P and transporting it to a recording area, in which the sheet detection lever 56 coming in contact with the leading end of the recording medium in the transport direction to detect it and the width detection lever 59 coming in contact with the recording medium having the wide width in the direction orthogonal to the transport direction to detect the width of the recording medium are disposed at the upstream side of the recording area in the transport direction, the sheet detection lever 56 is disposed substantially at the center part of the recording medium in the width direction orthogonal to the transport direction, the width detection lever 59 is disposed at the side part away from the center part toward one side in the width direction, and the urging force of the width detection lever 59 is set to be smaller than the urging force of the sheet detection lever 56 to the recording medium.

By structuring as stated above, at the leading edge part at the time when the recording medium is transported, the contact resistances of both the detection levers 56, 59 in the width direction are balanced at both sides of the center line of the width of the recording medium, and by this, there is obtained an effect that the oblique movement of the transported recording medium is prevented.

According to this embodiment, in the recording medium transport device 3, the pickup roller 12 for feeding the recording medium to the transport roller unit is provided at the upstream side of the transport roller unit, and the sheet detection lever 56 and the width detection lever 59 are disposed at one side and the other side of the pickup roller 12 respectively. By structuring as stated above, the contact resistances of both the detection levers 56, 59 in the width direction are balanced at both sides of the center line of the width of the recording medium, and there is obtained an effect that the oblique movement of the transported recording medium can be prevented without fail.

According to this embodiment, in the recording medium transport device 3, the urging forces of the respective levers 56, 59 are set so that in accordance with the distances between the pickup roller 12 and the respective levers 56, 59 in the width direction of the recording medium, the values obtained by multiplying the distances by the urging forces become almost equal to each other. By structuring as stated above, the resistance moments due to the contact resistances of both the detection levers 56, 59 in the width direction are balanced at both sides of the center line of the width of the recording medium and there is obtained an effect that the oblique movement of the transported recording medium can be prevented more certainly.

According to this embodiment, in the recording medium transport device 3, the urging forces of the respective levers 56, 59 are given by urging springs 64, 65. Thus, in addition to the above-described effects of this embodiment, there is obtained an effect that setting and adjustment of absolute values of the urging forces can be easily performed.

According to this embodiment, in the recording medium transport device 3, the transport roller unit includes the transport roller 30 and the pinch rollers 31 for nipping and transporting the recording medium, the pinch roller holder body 40 for supporting the plural pinch rollers 31 includes the shaft support parts respectively for rotatably supporting the halfway parts of the sheet detection lever 56 and the width detection lever 59, and the respective shaft support parts of the pinch roller holder body 40 include the insertion holes through which the sheet detection lever 56 and the width detection lever 59 pass and are disposed. According to this embodiment, since the shaft support parts for rotatably supporting the halfway parts of both the detection levers 56, 59 are previously formed in the pinch roller holder body 40, the pinch roller holder body 40 has only to be mounted to a specified place in a state where the respective detection levers 56, 59 are previously mounted to the pinch roller holder body 40, and there is obtained an effect that the trouble of mounting of the detection levers 56, 59 and the transport device of the recording medium can be saved.

According to this embodiment, in the recording medium transport device 3, each of the shaft support parts includes the noncircular shaft 61 in which at least part of the circular section is cut away, and each of the bearing tube parts formed at halfway parts of the sheet detection lever 56 and the width detection lever 59 includes the insertion groove formed by cutting, which can be fitted to the noncircular shaft 61 only when the detection part side of each of the sheet detection lever 56 and the width detection lever 59 is inserted into the insertion hole in the direction orthogonal to the axial line of the noncircular shaft 61.

Accordingly, in addition to the above-described effects of this embodiment, since the noncircular shaft 61 is previously provided in the pinch roller holder body 40, contrary to the prior art, it becomes unnecessary to perform such an operation that a support shaft is made to pass through between an intermediate part of each detection lever and a shaft support part in an axial line direction, and the mounting operation can be performed very easily. Then, attachment/detachment can be performed only when the respective detection levers 56, 59 are put in specified postures, and in other postures, the respective detection levers do not come off from the pinch roller holder body 40 carelessly, and therefore, there is obtained an effect that the mounting operation is easy, and an accident such as separation of the detection lever does not occur.

According to this embodiment, in the recording medium transport device 3, each of the shaft support parts includes the pair of noncircular shafts 61 opposite to each other to have the suitable gap at their free end sides, and the bearing tube parts are formed to protrude in opposite directions to each other at the halfway parts of the respective levers 56, 59.

By structuring as stated above, in addition to the above-described effects of this embodiment, there is obtained an effect that the lever parts for the contact part and the detected part are provided to protrude in the orthogonal direction from the halfway parts of the bearing tube parts in the axial direction, and the well-balanced detection levers can be formed.

According to this embodiment, in the recording medium transport device 3, the respective urging springs 64, 65 for applying the urging forces to the respective levers 56, 59 include the winding parts fitted to the bearing tube parts of the sheet detection lever 56 and the width detection lever 59, the first engagement parts extending from one sides of the winding parts are engaged with the sheet detection lever 56 and the width detection lever 59, and the second engagement parts extending from the other sides of the winding parts are engaged with the respective shaft support parts.

By structuring as stated above, in addition to the above-described effects of this embodiment, there is obtained an effect that the attachment operation of the urging springs 64, 65 becomes easy.

According to this embodiment, in the recording medium transport device 3, the pinch roller holder body 40 includes the base part to be attached to the back side of the frame 27 and the support parts for supporting the pinch rollers 31, which are integrally molded, and the coupling parts between the base part and the support parts are formed to be thin. Thus, since the plural support parts are connected to the one base part through the thin coupling parts and are united, the number of parts is reduced, and the one base part has only to be mounted to the back side of the frame 27 so that the assembling operation can be greatly simplified.

Further, since the plural support parts are connected to the one base part through the thin coupling parts, in each of the support parts, the pinch roller 31 can be independently pressed to the drive roller 30, and a secure nipping action can be given according to the width of the transported recording medium.

According to this embodiment, in the recording medium transport device 3, the insertion holes are provided in the respective coupling parts to extend into the base part and the support parts. Thus, there is obtained an effect that in the respective shaft support parts, the respective detection levers 56, 59 can be mounted without being disturbed by the support parts and the coupling parts.

According to this embodiment, in the recording medium transport device 3, the pinch roller holder body 40 includes the engagement hook parts attachable and detachable to/from the frame disposed at the upstream side of the recording area in the transport direction. Thus, there is obtained an effect that the mounting operation of the pinch roller holder body to the frame can be easily performed.

According to the this embodiment, in the image forming apparatus 1 having the recording medium transport device 3, the platen is disposed to face the nozzle surface of the ink-jet recording head at the downstream side of the transport roller unit in the transport direction of the recording medium. By structuring as stated above, there is obtained an effect that an assembling operation of the ink-jet image forming apparatus 1 is simplified, and the low-cost apparatus can be provided.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. A recording medium transport device comprising:

a transport roller unit that nips a recording medium and transports it to a recording area, the transport roller unit including a sheet detection lever coming in contact with a leading end part of the recording medium in a transport direction to detect it and a width detection lever coming in contact with the recording medium having a width in a width direction orthogonal to the transport direction to detect the width of the recording medium, the sheet detection lever and the width detection lever being disposed at an upstream side of the recording area in the transport direction, the sheet detection lever being disposed substantially at a center part of the recording medium in the width direction, the width detection lever being disposed at a side part away from the center part toward one side in the width direction;

a first urging spring that urges the sheet detection lever; and a second urging spring that urges the width detection lever with an urging force set to be smaller than an urging force of the first urging spring.

2. The recording medium transport device according to claim 1, further comprising:

a pickup roller that feeds the recording medium to the transport roller unit, the pickup roller disposed at an upstream side of the transport roller unit;

wherein the sheet detection lever and the width detection lever are disposed at one side and the other side of the pickup roller respectively.

3. The recording medium transport device according to claim 2, wherein the urging forces of the respective levers are set so that in accordance with distances between the pickup roller and the respective levers in the width direction of the recording medium, values obtained by multiplying the distances by the urging forces become almost equal to each other.

4. The recording medium transport device according to claim 1, wherein the urging forces of the respective levers are given by urging springs.

5. The recording medium transport device according to claim 1, wherein the transport roller unit includes a transport roller and pinch rollers for nipping and transporting the recording medium;

a pinch roller holder body for supporting the plural pinch rollers includes shaft support parts for rotatably supporting halfway parts of the sheet detection lever and the width detection lever respectively, and the respective shaft support parts of the pinch roller holder body include insertion holes through which the sheet detection lever and the width detection lever pass and are disposed.

6. The recording medium transport device according to claim 5, wherein each of the shaft support parts includes a noncircular shaft in which at least part of a circular section is cut away; and each of a plurality bearing tube parts are formed at halfway parts of the sheet detection lever and the width detection lever, each bearing tube part including an insertion groove formed by cutting, which can be fitted to the noncircular shaft only when a detection part side of each of the sheet detection lever and the width detection lever is inserted into the insertion hole in a direction orthogonal to an axial line of the noncircular shaft.

7. The recording medium transport device according to claim 6, wherein each of the shaft support parts includes a pair of noncircular shafts opposite to each other to have a predetermined gap at their free end sides; and the bearing tube parts are formed to protrude in opposite directions to each other at the halfway parts of the respective levers.

8. The recording medium transport device according to claim 6, wherein the respective urging springs for applying the urging forces to the respective levers include winding parts fitted to the bearing tube parts of the sheet detection lever and the width detection lever, first engagement parts extending from one sides of the winding parts are engaged with the sheet detection lever and the width detection lever, and second engagement parts extending from the other sides of the winding parts are engaged with the respective shaft support parts.

9. The recording medium transport device according to claim 6, wherein the pinch roller holder body includes a base part to be attached to a back side of a frame and support parts for supporting the pinch rollers, the base part and the support parts being integrally molded; and coupling parts between the base part and the support parts are formed to be thin.

10. The recording medium transport device according to claim 9, wherein the insertion holes are provided in the respective coupling parts to extend into the base part and the support parts.

11. The recording medium transport device according to claim 5, wherein the pinch roller holder body includes engagement hook parts attachable to and detachable from the frame disposed at an upstream side of the recording area in the transport direction.

12. An image forming apparatus comprising:

a recording medium transport device; and a platen disposed to face a nozzle surface of an ink-jet recording head at a downstream side of a transport roller unit in a transport direction of a recording medium;

the recording medium transport device comprises:

the transport roller unit that nips a recording medium and transports it to a recording area, the transport roller unit including a sheet detection lever coming in contact with a leading end part of the recording medium in a transport direction to detect it and a width detection lever coming in contact with the recording medium having a width in a width direction orthogonal to the transport direction to detect the width of the recording medium which are disposed at an upstream side of the recording area in the transport direction, the sheet detection lever being disposed substantially at a center part of the recording medium in the width direction, the width detection lever being disposed at a side part away from the center part toward one side in the width direction;

a first urging spring that urges the sheet detection lever; and a second urging spring that urges the width detection lever with an urging force set to be smaller than an urging force of the first urging spring.

13. An image forming apparatus comprising:

a transport roller pair including a pinch roller and a drive roller which nip and transport a recording medium to a recording area;

a frame including a main frame part disposed at an upstream side of the transport roller pair in a transport direction;

a pinch roller holder body including a base part to be attached to the frame and a support part extending from the main frame part to a down stream side in the transport direction and supporting the pinch roller;

a registration sensor disposed at an upstream side of the main frame part in the transport direction;

a width sensor disposed at the upstream side of the main frame part;

a sheet detection lever including a first lower lever part having a first contact part coming in contact with the recording medium on one end thereof and having a first bearing part rotatably attached to the pinch roller holder body on the other end thereof, and a first upper lever part being accessible to the registration sensor, the sheet detection lever is disposed substantially at a center part of the recording medium in a width direction orthogonal to the transport direction;

a first urging spring that urges the sheet detection lever;

a width detection lever including a second lower lever part having a second contact part coming in contact with the recording medium having a wide width on one end thereof and having a second bearing part rotatably attached to the pinch roller holder body on the other end thereof, and a second upper lever part being accessible to the width sensor, the width detection lever is disposed at a side part away from the center part toward one side in the width direction; and a second urging spring that urges the width detection lever with an urging force set to be smaller than an urging force of the first urging spring.

14. The image forming apparatus according to claim 13, wherein the first and second urging springs comprise torsion springs.

15. The image forming apparatus according to claim 14, wherein a shape of the first urging spring is different from that of the second urging spring.

* * * * *